United States Patent [19]

Larguia

[11] 4,423,577

[45] Jan. 3, 1984

[54] ARRANGEMENTS FOR SELECTIVELY CHANGING THE RADIATION AND VIBRATION TRANSMISSION PROPERTIES OF PANELS

[76] Inventor: Constancio Larguia, Carlos Pellegrini 885, Buenos Aires, Argentina

[21] Appl. No.: 281,360

[22] Filed: Jul. 8, 1981

[30] Foreign Application Priority Data

Jul. 8, 1980 [AR] Argentina ..... 281696

[51] Int. Cl.[2] ..... E04H 14/00

[52] U.S. Cl. ..... 52/171; 52/308

[58] Field of Search ..... 52/171–173, 52/304, 305, 307, 308, 798; 428/34

[56] References Cited

U.S. PATENT DOCUMENTS

| | | | |
|---|---|---|---|
| 3,045,297 | 7/1962 | Ljungdahl | 428/34 |
| 3,341,395 | 9/1967 | Weber | 52/799 |
| 3,903,665 | 9/1975 | Harrison | 52/173 |

*Primary Examiner*—James L. Ridgill, Jr.

*Attorney, Agent, or Firm*—Fleit, Jacobson, Cohn & Price

[57] ABSTRACT

A panel having selectively variable radiation and vibration transmitting properties comprising a substantially two-dimensional normally transparent or translucid hollow structure for receiving therein low density particulate material having predetermined thermal and/or optical characteristics, said hollow structure having an uppermost part and a lowermost part and said lowermost part having at least one end portion, the particulate material being fed into said hollow structure through the uppermost part thereof and withdrawn from said hollow structure through said end portion of the lowermost part thereof for varying the radiation and vibration transmitting properties of the panel, a multi-perforated plate member defining the bottom wall of said hollow structure, the multiplicity of perforations thereof communicating the interior and exterior thereof, said plate member being shaped to have alternative crests and valleys, said crests and valleys being formed by areas of said wall facing towards and away from said end portion, the perforations in said bed member extending only through said areas facing said end portion so that air injected into said space through said perforations will blow particulate material resting on said bed member towards said end portion, while said areas facing away from said end portion help to direct said blown particulate material towards said end portion thus enhancing evacuation of said space.

7 Claims, 5 Drawing Figures

ARRANGEMENTS FOR SELECTIVELY CHANGING THE RADIATION AND VIBRATION TRANSMISSION PROPERTIES OF PANELS

BACKGROUND OF THE INVENTION

1. Field of the Invention

The present invention relates in general terms to arrangements for selectively varying the radiation and vibration transmitting properties of panels having two substantially parallel sheets of transparent or translucid material mounted in a supporting frame, said two sheets being spaced apart and defining therebetween an intermediate closed space for receiving, from a reservoir, low density solid particulate material having predetermined thermal and/or optical characteristics, and more particularly to an improvement in the structure of the panels of such arrangements and whereby the panels can be emptied of particulate material more thoroughly and efficiently than heretofore.

Those skilled in the art are aware of the importance of an efficient and rapid evacuation of the panels since not only for aesthetic reasons but also to insure prompt readiness for re-filling with the particulate material.

2. Description of the Prior Art

In my application No. 217.097 filed on Dec. 16, 1980 and which is a continuation of my application No. 961.852 filed on Nov. 17, 1978, I have disclosed an improved arrangement of the general type described above. I have now found that the panels therein described, as well as other types of known panels, some of which are mentioned in the specifications of my prior cases, can be improved so as to facilitate, enhance and speed-up removal of the particulate material, particularly the final amounts thereof which settle on the bottom wall of the panel. In the documents of my prior applications, particularly in connection with FIGS. 3 and 4, I have explained that the outlet (at the bottom of the panel) for the particulate material should preferably be spaced from an inlet (also at the bottom of the panel) for air only so that the ingress of air will help to sweep the particulate material towards the just mentioned outlet.

However, due to whirlwinds and laminar flow effects the space within the panel is not depleted of particles in an efficient manner.

Furthermore, it is a known fact that the entraining capacity of a current of air depends on its speed. While the air flows within a restricted pipe its pressure and speed can be maintained at an adequate value and therefore the amount of particulate material it entrains is adequate. However, when the air leaves the pipe and ingresses into the space within the panel, its pressure and speed fall and therefore the particulate material in suspension also falls. Obviously, the larger the dimensions of the panel the worse this effect becomes.

I have now found that if the inlet for air only into the panel is divided into a multiplicity of smaller inlets having a specific orientation and if the bottom wall of the panel is of a particular configuration, the sweeping of the particulate material towards its outlet is substantially improved with a reduction of energy required since the consumption of power with such an arrangement is considerably less than the power consumption in previous structures; this is due to the synergic effect produced by the combination of the new shape of the bottom wall, the subdivision of outlets and the orientation thereof.

So as to more fully understand some of the various possible uses of the improvement of the present invention, it must be said that the improved panel finds application not only as an external wall of a building (this is the more conventional use) but also in hot-houses and solar energy detectors wherein solar radiations must reach the detectors during certain hours but heat must not be lost during the hours that there is no useful radiation available.

SUMMARY OF THE INVENTION

In accordance with the present invention there is provided a panel having selectively variable radiation and vibration transmitting properties comprising a substantially two-dimensional normally transparent or translucid hollow structure for receiving therein low density particulate material having predetermined thermal and/or optical characteristics, said hollow structure having an uppermost part and a lowermost part and said lowermost part having at least one end portion, the particulate material being fed into said hollow structure through the uppermost part thereof and withdrawn from said hollow structure through said end portion of the lowermost part thereof for varying the radiation and vibration transmitting properties of the panel, the improvement comprising a multiperforated plate member defining the bottom wall of said hollow structure, the multiplicity of perforations thereof communicating the interior and exterior thereof, said plate member being shaped to have alternative crests and valleys, said crests and valleys being formed by areas of said wall facing towards and away from said end portion, the perforations in said bed member extending through said areas facing towards said end portion.

BRIEF DESCRIPTION OF THE DRAWINGS

For a better understanding of the present invention, reference will now be made, by way of example, to the enclosed drawings, in which several embodiments are disclosed which facilitate the comprehension of the principle of the invention, and in which.

Figure 1:
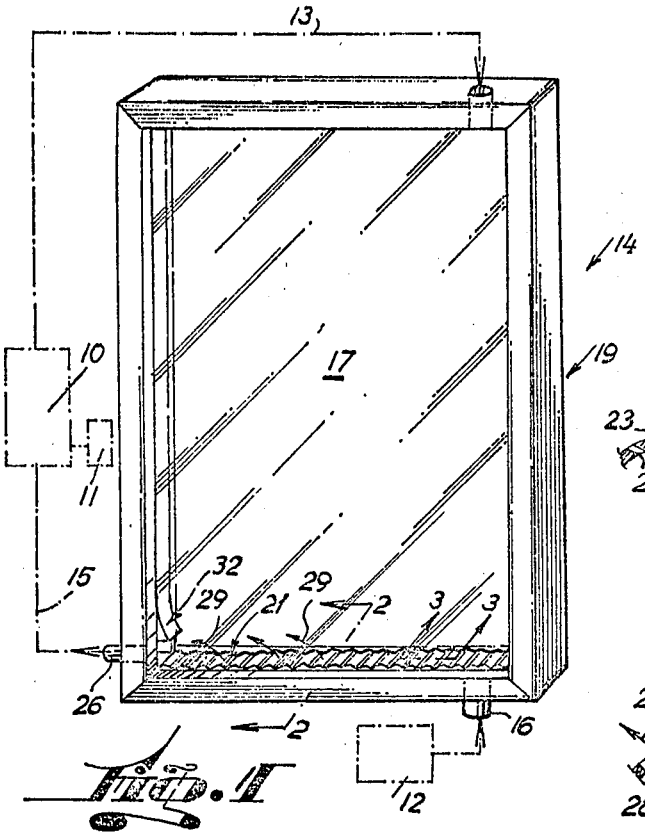
FIG. 1 is a perspective view of a panel structure incorporating the features of the present invention and shown schematically connected into an arrangement for selectively varying the radiation and vibration transmitting properties of the panel.

So as to simplify the detailed description of the present invention, the panel to be described is one forming part of a window connected into an arrangement comprising a reservoir 10 for low density solid particulate material, such as foamed polyurethane, and having predetermined thermal and/or optical characteristics, and an air blower 11 which, when activated, blows air into reservoir 10 so that the air blown thereinto entrains particulate material and leads it through a pipe system 13 to the uppermost part of a window panel 14. The above mentioned arrangement also comprises a further air blower 12 connected through inlet 16 to the lowermost part of the window panel 14 so that air entering the panel 14 through inlet 16 will help to evacuate the particulate material from window panel 14 through pipe system 15 connected to an outlet 26 at one end of the lowermost part of the window panel 14, whereby the particulate material will return to reservoir 10.

The window panel 14 of the present invention comprises two substantially parallel sheets 17 and 18 of transparent or translucid material mounted in a supporting frame 19, the two sheets 17 and 18 are spaced apart and define therebetween an intermediate closed space 20 for receiving and retaining the low density particulate material which it receives from the reservoir 10.

The word "closed" is to be interpreted in a relative way since obviously it only intends to signify that the walls 17–18 defining the space 20 prevent the particulate material from escaping therefrom. It will be obvious to those experts in the art that such space 20 only has to be hermetic to the escape of particles and therefore it can have openings enabling the escape of air but preventing the escape of particles.

While the lateral and upper sides of space 20 are defined by frame 19, the bottom wall is defined by a multi-perforated bed member 21 which prevents direct communication between space 20 and inlet 16. To this effect inlet 16 is connected to a manifold 22 separated from space 20 by the multi-perforationed bed member 21.

Figure 3:
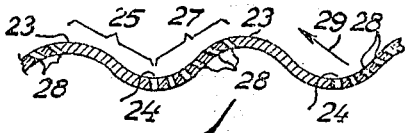
FIG. 3 is a partial cross-section, taken through 3—3 in FIG. 1.
Figure 4:
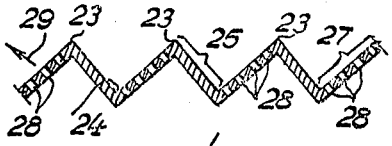
FIG. 4 is a cross-section, similar to that of FIG. 3 but showing an alternative embodiment.

Bed member 21 is corrugated and has a sinusoidal configuration in longitudinal section so as to have alternative crests 23 and valleys 24 parallelly arranged one to the other as shown in FIGS. 3 and 4. Crests 23 and valleys 24 are formed by areas 25 of said bed member 21 facing away from the end of the lowermost part of the window panel 14 at which outlet 26 is placed and by areas 27 of said bed member 21 facing towards the end of the lowermost part of the window panel 14 at which outlet 26 is placed.

Figure 2:
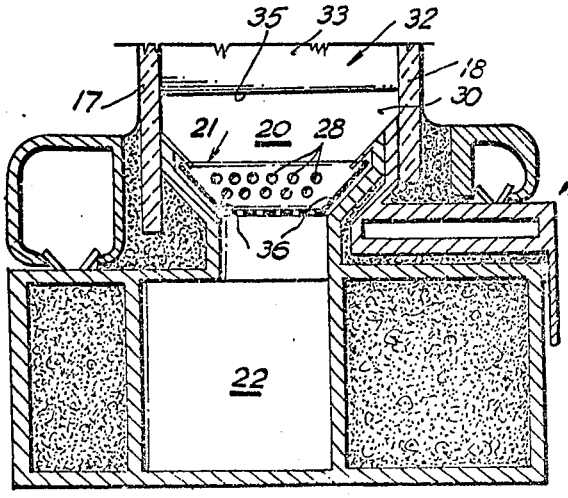
FIG. 2 is a cross-section through 2—2 in FIG. 1.
Figure 5:
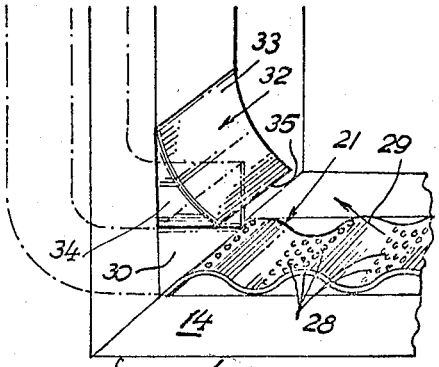
FIG. 5 is an enlarged view of the bottom left hand corner of the panel shown in FIG. 1.

The areas 27 facing towards outlet 26 have a multiplicity of perforations 28 as clearly seen in FIGS. 2 and 3.

By way of perforations 28 air is blown into space 20 in the direction of arrows 29 thus causing the particulate material to be blown towards outlet 26. It has been found that it is preferable for the pressure of the air leaving perforations 28 to merely be sufficient to cause the particulate material to jump from one valley to another thus travelling orderly over the surface of bed member 21 thereby avoiding excessive turbulence within space 20 since such turbulence will only tend to return the particulate material to the areas remote from outlet 26. However, very similar results can be obtained by using air pressures causing the particulate material to jump over two or three crests particularly if the height of the crests is small as suggested by FIG. 1.

By subdividing the single air stream egressing from inlet 16 and manifold 22 into a multiplicity of minor jets through perforations 28 it is possible to maintain an adequate volume and pressure of air for the efficient transport of the particulate material towards the outlet 26 in spite of the increased volume of space 20 with regard to manifold 22. During operation certain particles fall through space 20 onto area 25 due to gravity; these particles are thereafter caused to fall towards the valleys whereby they again return to where they receive the effect of the air ejecting through perforations 28, whereby they are again blown towards outlet 26.

As the air entering space 20 from perforations 28 is in the general direction of arrows 29, the air streams exiting from perforations 28 impinges against the walls surrounding mouth 30 leading to outlet 26 thus distorting the even flow patterns of the air streams exiting from perforations 28. To prevent this, a deviation member 32 is mounted above mouth 30 thus dividing the air streams close to mouth 30 into one secondary stream which rises and moves away from mouth 30 and a main stream entering mouth 30. With this aim in mind deviation member 32 is provided with an upward deflecting surface 33 and a bottom flat surface 34 which together with the crest 23 and valley 24 closest to mouth 30 cause a depression below and around the sharp edge 35 of deviation member 32 whereby the particles are attracted towards mouth 30. In addition, the secondary stream rising due to deflecting surface 32 also helps to evenly spread out on bed member 21 the particulate material which has failed to enter through mouth 30 into outlet 26.

As shown in FIG. 4, bed member 21 can also be of saw tooth configuration in longitudinal section; the same advantages have been obtained by this shape.

In order to maintain the speed of the air flow through perforations 28 without increasing the pumping capacity of air blower 12 I have found that it is possible to reduce the area of bed member 21 in which perforations 28 are formed. However, it is decidely not advisable to make perforations 28 only in a reduced area of bed member 21 because this could cause the accumulation of particulate material in those areas where perforations are non-existent. To maintain an adequate flow of air without causing the accumulation of particles in certain areas of bed 21. I have found that by bed member 21 should be shaped so as to be comprised within an imaginary right prism of trapezoidal shape in cross-section as shown in FIG. 2 and with its larger base facing space 20 and its smaller base facing manifold 22. In this way, perforations 28 are only formed in an area of bed 21 directly above manifold 22 and communicated therewith while any of falling particles which may fall on walls 36 are caused to return to the area provided with perforations 28.

The provision of a trapezoidal shape, in cross-section, for bed member 21 is particularly suitable when it is necessary to provide a panel having a relatively large distance between sheets 17 and 18. The distance between sheets 17 and 18 is established as a function of the isolating features of the panel since an increased distance will accommodate more particulate material.

However, it is not possible to increase the distance between sheets 17 and 18 independently of the surface of bed member 21 provided with perforations 28 since the necessary angle of inclination is for walls 36, for formed polyurethane, more than 45° with regard to the horizontal.

It will be understood, that improvements may be introduced in the embodiments described by way of example and modifications may be made in the construction and materials employed, without departing from the scope of the invention.

I claim:

1. In an arrangement for selectively varying the radiation and vibration transmitting properties of a panel usable in buildings and other structures comprising a panel having two substantially parallel sheets of transparent or translucid material mounted in a supporting frame, said two sheets being spaced apart and defining therebetween an intermediate closed space for receiving, from a reservoir, low density solid particulate material having predetermined thermal and/or optical characteristics, said space having an uppermost part and a lowermost part and said lowermost part having at least one end portion, the particulate material being fed into said closed space from the uppermost part thereof and returned to said reservoir from said end portion of the lowermost part thereof, the improvement comprising a multi-perforated bed member defining the bottom wall of said space, said bottom wall being shaped to have alternative crests and valleys parallelly arranged one to another, said crests and valleys being formed by areas of said bed member facing towards and away from said end portion, the multiplicity of perforations in said bed member extending only through said areas facing towards said end portion whereby air injected into said space through said perforations will below particulate material resting on said bed member towards said end portion, while said areas facing away from said end portion help to direct said blown particulate material towards said end portion thus enhancing evacuation of said space.

2. The improvement of claim 1, wherein said bed member is of sinusoidal configuration in longitudinal section.

3. The improvement of claim 1, wherein said bed member is shaped so as to be comprised within an imaginary right prism of trapezoidal cross-section with its larger base facing said space.

4. The improvement of claim 1, wherein deflection means are positioned adjacent said end portion to enhance flow of said particulate material out of said closed space.

5. A panel having selectively variable radiation and vibration transmitting properties comprising a substantially two-dimensional normally transparent or translucid hollow structure for receiving therein low density particulate material having predetermined thermal and/or optical characteristics, said hollow structure having an uppermost part and a lowermost part and said lowermost part having at least one end portion, the particulate material being fed into said hollow structure through the uppermost part thereof and withdrawn from said hollow structure through said end portion of the lowermost part thereof for varying the radiation and vibration transmitting properties of the panel, the improvement comprising a multi-perforated plate member defining the bottom wall of said hollow structure, the multiplicity of perforations thereof communicating the interior and exterior thereof, said plate member being shaped to have alternative crests and valleys, said crests and valleys being formed by areas of said wall facing towards and away from said end portion, the perforations in said bed member extending only through said areas facing towards said end portion.

6. In an arrangement for selectively varying the radiation and vibration transmitting properties of panels usable in buildings and other structures comprising a panel having two substantially parallel sheets of transparent or translucent material mounted in a supporting frame, said two sheets being spaced apart and defining therebetween an intermediate closed space for receiving, from a reservoir, low density solid particulate material having predetermined thermal and/or optical characteristics, said space having an uppermost part and a lowermost part and said lowermost part having at least one end portion, the particulate material being fed into said closed space from the uppermost part thereof and returned to said reservoir from said end portion of the lowermost part thereof, said closed space also having an inlet for air only, the improvement comprising a multi-perforated bed member defining the bottom wall of said space for the particulate material to accumulate thereon without passing therethrough when said material is feed into said space, said perforations in said bed member communicating said closed space with said inlet for air only, whereby the air stream to be blown into said closed space is subdivided into a multiplicity of minor streams and ingresses through said perforations, said perforations extending in a direction generally towards said end portion, whereby air injected into said space through said perforations will cause said particulate material accumulated on said bed member to travel towards said end portion.

7. In an arrangement for selectively varying the radiation and vibration transmitting properties of panels usable in buildings and other structures comprising a panel having two substantially parallel sheets of transparent or translucent material mounted in a supporting frame, said two sheets being spaced apart and defining therebetween an intermediate closed space for receiving, from a reservoir, low density solid particulate material having predetermined thermal and/or optical characteristics, said space having an uppermost part and a lowermost part and said lowermost part having at least one end portion, the particulate material being fed into said closed space from the uppermost part thereof and returned to said reservoir from said end portion of the lowermost part thereof, said closed space also having an inlet for air only, the improvement comprising a multi-perforated bed member defining the bottom wall of said space for the particulate material to accumulate thereon without passing therethrough when said material is fed into said space, said perforations in said bed member communicating said closed space with said inlet for air only, at least one row of said perforations extending in a direction generally towards said end portion, whereby air injected into said space through said perforations will cause said particulate material accumulated on said bed member to travel towards said end portion.

* * * * *